United States Patent [19]

Toth

[11] 4,404,766

[45] Sep. 20, 1983

[54] MAGNETIC TOY

[76] Inventor: Kalman A. Toth, 24 Jean La., Monsey, N.Y. 10952

[21] Appl. No.: 262,902

[22] Filed: May 12, 1981

[51] Int. Cl.[3] ..... A63H 33/26; G09F 19/00

[52] U.S. Cl. ..... 46/239; 434/301; 40/426; 46/238

[58] Field of Search ..... 46/236, 237, 238, 239, 46/242; 116/204; 434/301, 186; 40/426, 600

[56] References Cited

U.S. PATENT DOCUMENTS

| | | | |
|---|---|---|---|
| 2,388,664 | 11/1945 | Bandur et al. | 46/236 |
| 3,432,941 | 3/1969 | Minchom | 434/301 |
| 3,478,452 | 11/1969 | Bidwell | 46/239 |
| 3,600,737 | 8/1971 | Shore | 46/239 |
| 3,855,725 | 12/1974 | Tollefson | 46/238 |
| 3,938,263 | 2/1976 | Tate | 40/426 |

OTHER PUBLICATIONS

"Newly Designed Magnet Model", No. 1800, p. 28, Welch Physics and Chemistry Digest, May, 1954.

*Primary Examiner*—Gene Mancene
*Assistant Examiner*—Michael J. Foycik
*Attorney, Agent, or Firm*—Lieberman, Rudolph & Nowak

[57] ABSTRACT

A magnetic toy is provided which is capable of teaching basic scientific principles, provides a high degree of challenge to the user in operation and is low in cost. The toy has a plurality of bar magnets rotatably mounted between upper and lower support surfaces and a magnetic wand element. When the magnetic wand element is moved in the vicinity of the bar magnets one or more of the bar magnets will move and will also rotate with proper use of the magnetic wand.

5 Claims, 3 Drawing Figures

MAGNETIC TOY

FIELD OF THE INVENTION

This invention relates to articles of entertainment, and more particularly, to a magnetic toy designed to provide enjoyable entertainment at minimum cost and also designed to teach the basic scientific principles of magnetism.

BACKGROUND OF THE INVENTION

The number and variety of toys available in today's market is staggering as a vist to any toy store will demonstrate. In general toys available can be divided into two categories, relatively sophisticated toys providing a great deal of enjoyment an inevitable high cost and very simplistic and inexpensive toys which provide very little entertainment and for the most part are soon discarded and/or broken.

In addition to these two general categories there are also very few toys available in today's market that are capable of imparting any degree of scientific knowledge or information to the consumer. Moreover, the toys which are capable of teaching any amount of scientific knowledge are for the most part the most expensive toys, and often are too sophiticated to be of any use to small children or to those lacking a basic scientific background.

It is therefore an object of the present invention to provide a toy which is useful in teaching basic principles of science to the user of the toy.

It is a further object of the present invention to provide a toy which is easy to use, readily manufactured and inexpensive to the consumer.

It is a still further object of the present invention to provide a toy which is a challenge to the user in operation while at the same time being low in cost and easy to use.

SUMMARY OF THE INVENTION

In accordance with the instant invention a magnetic toy is provided, comprising, a lower support surface, an upper support surface mounted above said lower support surface and supported by a plurality of support posts, a plurality of bar magnets, rotatably attached to selected ones of said support posts, and suspended between said upper and lower support surfaces; said bar magnets being free to rotate in a horizontal plane about their respective vertical axes, and a magnetic wand element adapted to be hand held by a user of said magnetic toy.

It is a feature of the instant invention that movement of the magnetic wand in the vicinity of said plurality of bar magnets causes movement of the bar magnets and skillful use of the magnetic wand will cause rotation of the bar magnets in a horizontal plane about their respective vertical axes.

It is another feature of the invention that the plurality of bar magnets are arranged in a square configuration between the upper and lower support surfaces.

It is a further and general feature of the invention that operation of the magnetic toy teaches basic scientific principles, offers a high degree of challenge to the user and is low in cost.

Various other general and specific objects and advantages of the instant invention will become apparent when reference is made to the following detailed description considered in conjunction with the accompanying drawings.

DETAILED DESCRIPTION

Figure 1A:
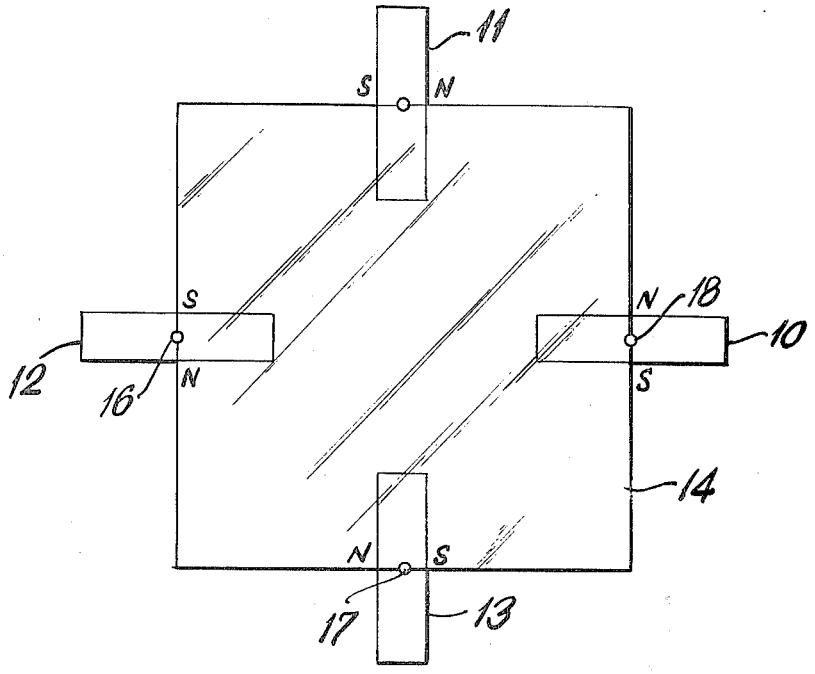
FIGS. 1A and 1B, illustrate, respectively, a top view of the instant invention.
Figure 1B:
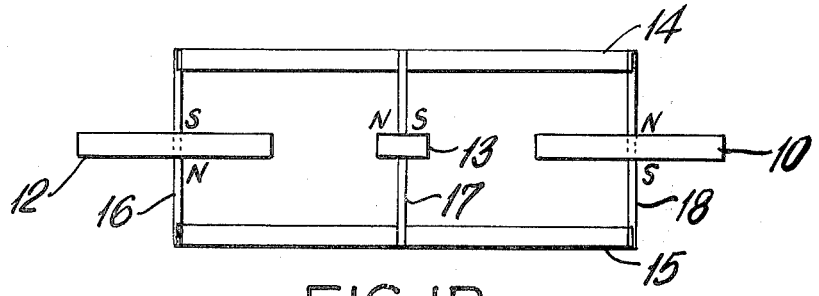

FIGS. 1A and 1B, illustrate respectively a top view and a side view of one element of the instant invention. This element is comprised of a plurality of bar magnets 10–13, pivotably mounted between an upper support surface 14 and a lower support surface 15, and arranged in a square configuration. The bar magnets are supported midway between the upper and lower support surfaces by posts 16–18, as well as an additional post to support bar magnet 11 which is not shown in FIG. 1B. If necessary additional posts could be used at the corners of support surfaces 14 and 15 to provide a rugged and durable structure that would resist damage resulting from rough handling.

Bar magnets are typically magnetized in a lengthwise direction, that is they have a North magnetic pole on one end of the bar magnet and a South magnetic pole on the other end of the bar magnet. In contrast the bar magnets used with the instant invention are magnetized accross their width, that is they have a North magnetic pole on one edge and a South magnetic pole on the opposite edge. The magnetic poles of each bar magnet are illustrated by the "N" and "S" labels shown in the figures.

The North magnetic pole of each bar magnet are repelled by the North magnetic pole of the remaining bar magnets and the South magnetic poles of each bar magnet are also repelled by each other. Conversely the North magnetic poles of each bar magnet are attracted to the South magnetic poles of the remaining bar magnets.

The attracting and repelling forces generated by the magnetic field surrounding each bar magnet results in the four magnets assuming two stable positions when mounted in the configuration of FIG. 1A. The first stable position is shown in FIG. 1A, wherein the North magnetic poles of magnets 10 and 11 and magnets 12 and 13 are adjacent to each other while the South magnetic poles of magnets 11 and 12 and magnets 10 and 13 are adjacent to each other. In the second stable position magnet 11 remains in the position shown in FIG. 1A, magnet 10 is at rest in a position rotated 90° counter clockwise, magnet 13 is at rest in a position rotated 180° from its position in FIG. 1A, and magnet 12 is at rest in a position rotated 90° clockwise. In either stable position movement of any one magnet will cause each of the other magnets to also move.

Each of bar magnets 10–13 is preferably comprised of a plastic based lightweight metal such as ceramic, so that each magnet will freely rotate about its vertical axix. Support surfaces 14 and 15 and support posts 16, 17 etc. can be comprised of any suitable material. It is preferred to construct support surface 14 of a transparent material such as plexiglas so that movement of the magnets can be readily observed as described below. Attachment of the support poles to the support surfaces and attachment of the magnets to the support posts can be accomplished in any suitable manner as long as each magnet is free to rotate about its verticle axis.

Figure 2:
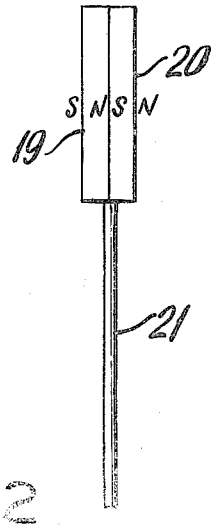
FIG. 2, illustrates a magnetic wand element used in conjunction with the instant invention.

FIG. 2 illustrates the second element of the instant invention. This element, a magnetic wand, is comprised of two additional bar magnets, 19 and 20, fixedly attached to a handle 21. The bar magnets 19 and 20 are mounted such that the North magnetic pole of one magnet is adjacent to the South magnetic pole of the remaining magnet. Handle 21 can be of any suitable length and diameter such that it can be easily grasped in the hand of the user.

To operate the toy of the instant invention the magnetic wand shown in FIG 2 is grasped by the user at handle 21, placed adjacent to the outward facing end of any of bar magnets 10–13, and moved back and forth in a vertical plane in front of the pivotably mounted bar magents. The interaction of the magnetic fields generated by magnets 19 and 20 with the magnetic field generated by the pivotable mounted bar magnets, in conjunction with the movement of the magnetic wand, causes one or more of magnets 10–13 to commence rotating about their respective vertical axis. The number of magnets which rotate depend upon the placement of the magnetic wand and the rate at which it is moved back and forth in a plane. Numerous practice sessions with a working model of the instant invention indicates that a certain amount of practice and a considerable amount of skill is required to achieve simultaneous rotation of all four bar magnets 10–13. It takes even greater skill to achieve rotation of all four bar magnets for a sustained period of time. Thus, operation of the toy of the instant invention, contains a high degree of challenge which, of course, is a necessary and attractive element of any game or toy. It is anticipated that rules of operation for the toy will be established awarding a certain number of points for achieving rotation of one bar magnet with additional points being awarded for each additional simultaneous rotation achieved. Also, of course, it is readily apparent that numerous other games could be devised with the instant invention that would give hours of pleasure to the user.

The toy of the instant invention is unique in several respects. First it is readily apparent that instructions could be included with the toy that would teach the basic scientific principles of magnetism and numerous experiments demonstrating these principles could be conducted by the user. Also, as previously described, operation of the toy requires a certain degree of skill, adding an exciting element of challenge totally lacking in many toys currently available. Finally, the toy of the instant invention is readily manufactured at reasonable cost making it an attractive consumer item. No toy currently available combines all three of these important elements, that is, the ability to teach basic scientific principles, providing an exciting challenge to the user in operation and low cost.

While a specific form of the invention has been described and illustrated herein, it is to be understood that the same may be varied within the scope of the appended claims without departing from the spirit of the invention.

I claim:

1. A magnetic toy, comprising, a lower support surface, an upper support surface mounted above said lower support surface and supported by a plurality of support posts, a plurality of bar magnets, rotatably attached to selected ones of said support posts and suspended between said upper and lower support surfaces, said bar magnets being free to rotate in a horizontal plane about their respective vertical axis, and a magnetic wand element adapted to be hand held by a user of said magnetic toy, said bar magnets being positioned such that the magnetic field of a pivotable bar magnet interacts with the magnetic field of each of the remaining pivotable bar magnets and with the magnetic field of said magnetic wand, whereby movement of said magnetic wand element in the vicinity of said plurality of bar magnets causes rotational movement of one or more of said plurality of bar magnets.

2. A magnetic toy in accordance with claim 1, wherein said plurality of bar magnets are arranged in a square configuration between said upper and lower support surfaces.

3. A magnetic toy in accordance with claim 2, wherein said magnetic wand element is comprised of two bar magnets fixedly attached to one end of a grasping handle, said two bar magnets being arranged such that a North magnetic pole of one of said two bar magnets is adjacent to a South magnetic pole of the other of said two bar magnets.

4. A magnetic toy in accordance with claim 3, wherein said bar magnets are comprised of a light weight metal.

5. A magnetic toy in accordance with claim 2, wherein four bar magnets are arranged in said square configuration.

* * * * *